United States Patent [19]

Sisk et al.

[11] 4,057,701

[45] Nov. 8, 1977

[54] CONTROL LEVER

[75] Inventors: Robert Michael Sisk; Lary Lynn Williams, both of Dubuque, Iowa

[73] Assignee: Deere & Company, Moline, Ill.

[21] Appl. No.: 712,606

[22] Filed: Aug. 9, 1976

[51] Int. Cl.[2] ..... H01H 9/06

[52] U.S. Cl. ..... 200/213; 200/6 A; 200/61.85; 200/329

[58] Field of Search ..... 200/157, 159, 61.85, 200/61.86, 61.88, 61.90, 61.91, 329, 330, 161, 6 A

[56] References Cited

U.S. PATENT DOCUMENTS

| | | | |
|---|---|---|---|
| 2,796,773 | 6/1957 | Wooler et al. | 200/157 |
| 3,073,918 | 1/1963 | Tarbox | 200/157 X |
| 3,142,227 | 7/1964 | Stringer | 200/157 |
| 3,484,010 | 12/1969 | Campbell | 214/767 |
| 3,996,433 | 12/1976 | Suzuki | 200/61.54 X |

OTHER PUBLICATIONS

"Dead Man Control Device", by A. Ludwig, Western Electric Technical Digest No. 1, Jan. 1966.

*Primary Examiner*—Harold Tudor

[57] ABSTRACT

A control system for a pair of hydraulic lift actuators for adjusting the position of a blade-carrying frame of a motor grader includes a pair of control levers respectively operatively connected to a pair of direction control valves which are, in turn, respectively connected to the pair of actuators and selectively operable by means of the levers to place the actuators in neutral, extension, retraction, and float conditions. Each of the levers includes a hollow handle section having an electric switch mounted therein and a finger-operable sleeve is reciprocably mounted on the handle section for selectively closing the switch. Each switch is connected to an electrically responsive portion of a respective one of the control valves and when closed causes the valve to shift to effect the float condition in an associated one of the actuators.

6 Claims, 3 Drawing Figures

CONTROL LEVER

BACKGROUND OF THE INVENTION

The present invention relates to a control lever and more particularly relates to a control lever for shifting a control valve such as to effect neutral, extension, retraction, and float conditions in an extensible and retractable hydraulic actuator.

Conventional motor graders include a main frame extending forwardly from an operator station and supported at its forward end by front wheels. The main frame is elevated above the ground and located therebeneath and having a forward end universally connected to the main frame is a drawbar or sub-frame having a circle structure fixed thereto. A blade-carrying standard is mounted for rotation on the circle structure and has a blade mounted thereon for endwise shifting movement relative thereto.

For the purpose of disposing the blade in desired positions relative to the surface or material to be worked, these conventional motor graders are often provided with a plurality of hydraulic functions including extensible and retractable lift and sideshift actuators connected between the main and sub-frames, extensible and retractable blade sideshift and blade pitch actuators connected between the sub-frame and the blade, and a blade rotation function for rotating the blade carrying standard on the circle structure.

In order to reduce the operator fatigue and ensure safe operation, it is a practice to group certain of the controls so that an operator may efficiently position the blade by operating controls with one hand while steering with the other hand. Two such controls heretofore grouped are a pair of control levers which are selectively movable independently or together among four different positions for effecting neutral, extension, retraction, or float conditions in an associated one of the actuators. This arrangement has not proved to be entirely satisfactory since it is sometimes desirable to only momentarily actuate one of the lift actuators to its float condition and heretofore this has necessitated the control levers to be shifted from a beginning position to their float position and then back to their beginning position.

SUMMARY OF THE INVENTION

According to the present invention there is provided a novel control lever and more specifically there is provided a control lever for controlling a direction control valve among positions for selectively effecting neutral, extension, retraction, and float conditions in an extensible and retractable hydraulic actuator.

An object of the invention is to provide a control lever capable of effecting an operative condition in a hydraulic actuator without necessitating movement of the lever.

A more specific object is to provide a control lever embodying an electric switch which may be closed without necessitating an operator to move his hand from a grip portion of the lever.

Yet another object is to provide a control lever, as described immediately above, having a hollow handle section containing a switch and including a finger-operable sleeve reciprocably mounted on the handle section for selected movement to effect closing of the switch.

These and other objects will become apparent from a reading of the ensuing description in conjunction with the appended drawings.

DESCRIPTION OF THE PREFERRED EMBODIMENT

Figure 1:
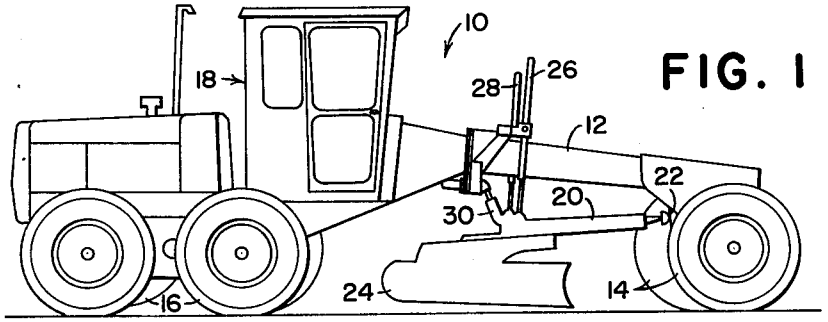
FIG. 1 is a schematic right side elevational view of a motor grader with which the present invention is particularly adapted for use.

Referring now to FIG. 1, therein is shown a motor grader 10 including an elongate main frame 12 supported at its forward end by a pair of front wheels 14 and at its rear end by a pair of tandem wheel sets 16. Mounted on a rear portion of the frame 12 is an operator station 18. The section of the frame 12 extending between the operator station 18 and the front wheels 14 is elevated above the mound and located therebeneath is a drawbar or sub-frame 20 having its forward end universally connected, as at 22, to the frame 12 at a location between the wheels 14. Mounted on the drawbar 20 is an elongate blade 24. Connected between the main frame 12 and the rear end of the drawbar 20 for adjusting the position of the latter and thus the position of the blade are right and left extensible and retractable hydraulic lift actuators 26 and 28, respectively, and an extensible and retractable side shift actuator 30.

Figure 2:
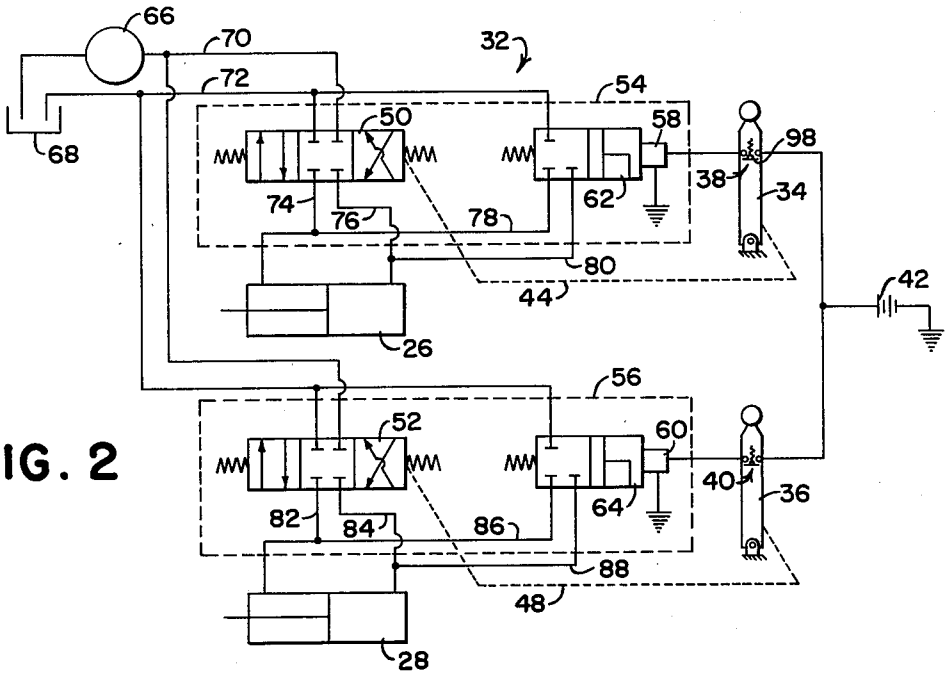
FIG. 2 is a schematic representation of a control system embodying a pair of control levers constructed according to the present invention.

Referring now to FIG. 2, there is shown a control system 32 for the lift actuators 26 and 28. As schematically shown here, the system 32 includes first and second identical control levers 34 and 36 respectively carrying normally open switches 38 and 40 connected in parallel with a battery 42. The levers 34 and 36 are pivotally mounted and are respectively mechanically linked, as functionally indicated by dashed lines 44 and 48, to first sections 50 and 52 of a pair of direction control valves 54 and 56 while the switches 38 and 40 are respectively connected in series with solenoids 58 and 60 respectively forming part of second sections 62 and 64 of the valves 54 and 56. A pump 66 has an inlet connected to a sump 68 and an outlet connected to the valve sections 50 and 52 via a branched feed line 70 while the sump 68 is connected to the valve sections 50 and 52, and 62 and 64 by a branched drain line 72. A pair of lines 74 and 76 connect the valve section 50 to opposite work ports of the actuator 26 while a pair of return lines 78 and 80 are respectively connected between the valve section 62 and the lines 74 and 76. Similarly, a pair of lines 82 and 84 connect the valve section 52 to opposite work ports of the actuator 28 while a pair of return lines 86 and 88 are respectively connected between the valve section 64 and the lines 82 and 84.

As shown in FIG. 2, the control levers 34 and 36 are in neutral positions wherein they hold the valve sections 50 and 52 in corresponding neutral positions to thus establish neutral conditions in the actuators 26 and 28 by blocking fluid in the opposite ends of each of them. Upon the levers 34 and 36 being pivoted rightwardly, the valve sections 50 and 52 will shift rightwardly to effect an extension condition in each of the actuators 26 and 28 by connecting the pump 66 to the right ends thereof while connecting their left ends to the sump 68.

Upon the levers 34 and 36 being pivoted leftwardly, the valve sections 50 and 52 will shift leftwardly to effect a retraction condition in each of the actuators 26 and 28 by connecting the pump 66 to the left ends thereof while connecting the sump 68 to the right ends thereof.

The valve sections 62 and 64 are illustrated in respective rightward closed positions wherein they block fluid communication between the sump 68 and the actuators 26 and 28. The condition of the actuators 26 and 28 will then be as determined by the valve sections 50 and 52. Upon the switches 38 and 40 being closed, the valve sections 62 and 64 will be shifted leftwardly to respective open positions wherein they connect the opposite ends of each of the actuators 26 and 28 to the sump 68 to thus establish respective float conditions in the actuators 26 and 28.

Figure 3:
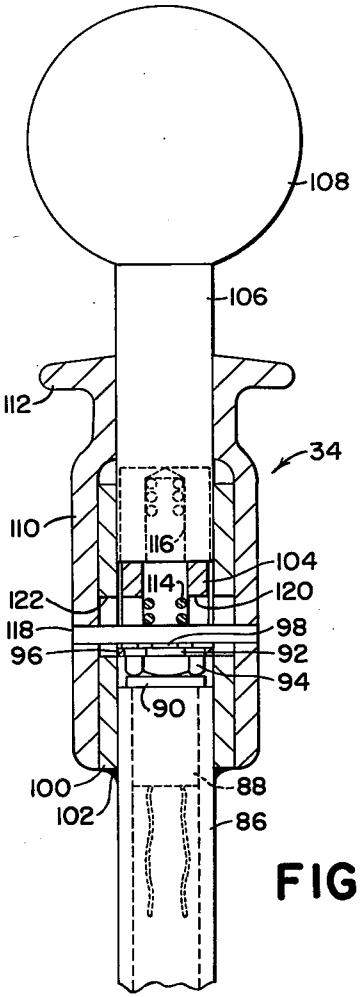
FIG. 3 is a view, partly in section, showing certain details of one of the levers shown in FIG. 2.

Referring now to FIG. 3, therein is shown an upper part of the control lever 34, it being understood that the upper part of the lever 36 is identical. The control lever 34 includes a hollow cylindrical section 86 having an open upper end having a cylindrical housing 88 of the switch 34 snugly received therein. A first flat washer 90 rests on the upper end of the section 86 and a threaded tubular mounting part 92 of the switch 34 extends through the washer 90 and has a nut 94 received thereon. A second flat washer 96 rests on the nut 94 and projecting through the washer 96 is an actuator button 98 of the switch 38, the button 98 being biased, as shown schematically in FIG. 2, toward an extended position for effecting a closed condition in the switch 38. A cylindrical extension 100 has its lower end received on the upper end portion of the section 86 and is fixed thereto by a weldment 102. A tubular spacer 104 has its lower end in engagement with the washer 96 and the switch 34 is held in place by means of a rod 106 having a lower end portion threadedly received in an upper end portion of the extension 100 and engaged with the top of the spacer 104. A knob 108 is fixed to the top of the rod 106 and serves as a hand grip.

Provided for controlling the position of the actuator button 98 is a finger-operable sleeve 110 made of an electrically nonconductive material such as nylon and having a lower portion slidably received on the extension 100 and a necked-in upper portion slidably received on the rod 106, the upper portion having a flared upper end 112 affording a finger grip. The sleeve 110 is shown in a normal lower position to which it is biased by means of a coil compression spring 114 compressed between a closed inner end of a spring receptacle 116 defined by a bore extending axially into the bottom end of the rod 106 and a pin 118 fixed diametrically in the sleeve 110 and received in aligned vertically elongated pairs of notches 120 and openings 122 respectively in the spacer 104 and in the extension 100, the pin 118, when the sleeve 100 is in its lower position as shown, being engaged with the button 98 so as to hold the latter in a retracted position to effect an open condition in the switch 38. Thus, it will be appreciated that an operator having his hand in engagement with the knob 108 can effect the closed condition of the switch 38 by merely inserting his finger below and raising up on the end 112 of the sleeve 110.

The operation of the invention is thought to be clear from the foregoing description suffice it to say that with the levers 34 and 36 mounted adjacent each other an operator can use one hand to selectively operate the levers 34 and 36 and the switches 38 and 40 either separately or simultaneously.

Also, while the invention is here described as being embodied in a motor grader control, it is to be understood that this is only a representative use.

We claim:

1. In a control mechanism including a control lever incorporating an electric switch whereby selective actuations of functions controlled by movement of the lever and operation of the switch may be accomplished without requiring the operator to move his hands from the lever, the improvement comprising: said lever defining a hand grip at one end thereof; a switch actuator including a sleeve slidably mounted on the lever adjacent to and for movement toward and away from the hand grip and including a finger grip; said lever being provided with a transverse opening elongated in the direction of movement of said sleeve; a pin extending through the opening and fixed to said sleeve for movement therewith; said lever including a hollow section traversed by said pin; a switch supported in said hollow section by the lever and including an actuator element located in the path of movement of the pin and biased in the direction of the hand grip toward a first position for effecting a closed condition in the switch; biasing means acting between the lever and the switch actuator for urging the latter in a direction away from the hand grip to a normal position wherein it holds the actuator element in a second position for effecting an open condition in the switch.

2. The control mechanism defined in claim 1 wherein said lever includes a tubular first section defining a portion of said hollow section and having an open end, and a second section having said hand grip at one end and a threaded second end; said switch including a body portion received in said open end with said actuator element then projecting toward said hand grip; a tubular extension defining another portion of said hollow section and receiving and being fixed to the upper end of said tubular first section; said second section having its second end threadedly received in an upper portion of said extension; and said biasing means being in the form of a coil compression spring compressed between the second section and the pin.

3. The control mechanism defined in claim 2 wherein said sleeve is nylon and embraces the second lever section and said extension.

4. A combined control lever and switch assembly comprising: said lever including a hand grip at one end thereof; said lever having a cavity defined at a location adjacent said hand grip; a switch located in said cavity and having an actuator button projecting toward the hand grip and movable between first and second positions for respectively closing and opening contacts of the switch; a sleeve slidably mounted on the lever and having a finger grip positioned so as to be reachable by the fingers of an operator while his hand is engaged with the hand grip; slot means located in the lever adjacent the button and elongated towards the hand grip; a pin connected to said sleeve and extending through said slot means and into said cavity above and positioned in engagement with said button; and biasing means located in the cavity and acting to urge the pin against the button to hold the latter in a first of said first and second positions and second biasing means forming part of the switch and urging the button toward a second of said first and second positions.

5. The control lever and switch assembly defined in claim 4 wherein said lever includes a tubular section having an open end; said switch being partially received in said tubular section and including a portion engaging said open end thereof; said lever including a tubular extension forming an enlarged continuation of the tubular section; a rod threadedly received in the tubular extension; and spacer means located in the tubular section between one end of the rod and the switch and being dimensioned so as to be held in tight engagement with the switch when the rod is threaded a predetermined distance into said tubular extension.

6. The control lever and switch assembly defined in claim 5 wherein a spring receptacle is formed axially in that end of the rod which is threadedly received in the extension; and said biasing means being in the form of a coil compression spring located partially in the spring receptacle and compressed between the rod and the pin.

* * * * *